US010630009B2

(12) United States Patent
Hashiguchi

(10) Patent No.: US 10,630,009 B2
(45) Date of Patent: Apr. 21, 2020

(54) CONNECTOR FOR OVERLAPPING TWO CIRCUIT BOARDS

(71) Applicant: Japan Aviation Electronics Industry, Limited, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/191,876

(22) Filed: Nov. 15, 2018

(65) Prior Publication Data

US 2019/0157782 A1 May 23, 2019

(30) Foreign Application Priority Data

Nov. 20, 2017 (JP) ..... 2017-222538

(51) Int. Cl.

| | |
|---|---|
| ***H01R 12/70*** | (2011.01) |
| ***H01R 12/61*** | (2011.01) |
| ***H01R 12/73*** | (2011.01) |
| *H01R 12/63* | (2011.01) |
| *H01R 13/645* | (2006.01) |

(52) U.S. Cl.

CPC ..... *H01R 12/7005* (2013.01); *H01R 12/613* (2013.01); *H01R 12/7052* (2013.01); *H01R 12/7064* (2013.01); *H01R 12/73* (2013.01); *H01R 12/63* (2013.01); *H01R 13/6456* (2013.01)

(58) Field of Classification Search

CPC .... H01R 12/7005; H01R 12/73; H01R 12/59; H01R 12/592; H01R 12/61; H01R 12/62; H01R 12/613; H01R 12/718; H01R 12/81; H01R 13/64; H01R 13/642

USPC ..... 439/74, 67, 77, 493, 55, 65, 66, 73, 75, 439/374

See application file for complete search history.

(56) References Cited

U.S. PATENT DOCUMENTS 3,304,109 A * 2/1967 Schuster ..... F16B 4/004 29/525
3,999,826 A * 12/1976 Yurtin ..... H01R 12/592 439/495
5,160,269 A * 11/1992 Fox, Jr. ..... H01R 12/61 439/197
5,306,162 A * 4/1994 Armendariz ..... H01R 12/7082 439/493
5,752,851 A * 5/1998 Zaderej ..... H01R 12/62 439/493

(Continued)

FOREIGN PATENT DOCUMENTS

CN 102474029 A 5/2012
EP 693797 A2 1/1996

(Continued)

*Primary Examiner* — Travis S Chambers

(74) *Attorney, Agent, or Firm* — Muncy, Geissler, Olds & Lowe, PC

(57) ABSTRACT

A connector includes a flat plate portion and one or more guide pins protruding formed on a surface of the flat plate portion, each of the one or more guide pins having a first fitting portion disposed on a root side of the guide pin and fitted with a first circuit board and a second fitting portion disposed on a tip side of the guide pin and fitted with a second circuit board, the first fitting portion being larger in size than the second fitting portion in a direction perpendicular to a connecting direction.

20 Claims, 8 Drawing Sheets

(56) References Cited

U.S. PATENT DOCUMENTS

| | | | | | |
|---|---|---|---|---|---|
| 5,993,247 | A * | 11/1999 | Kidd | H01R 12/78 | 439/329 |
| 6,077,090 | A * | 6/2000 | Campbell | H01R 12/62 | 439/67 |
| 6,419,501 | B1 * | 7/2002 | Okabe | H01R 12/79 | 439/77 |
| 6,537,082 | B2 * | 3/2003 | Hopfer, III | H01R 12/62 | 439/493 |
| 7,094,067 | B2 * | 8/2006 | Kitagawa | H01R 12/62 | 439/493 |
| 7,220,133 | B2 * | 5/2007 | Matsuo | G11B 7/12 | 439/260 |
| 8,998,624 | B2 * | 4/2015 | Ida | H01R 13/40 | 439/74 |
| 10,483,668 | B2 * | 11/2019 | Hashiguchi | H01R 12/613 | |
| 2011/0278048 | A1 | 11/2011 | Numakura | | |
| 2012/0129400 | A1 | 5/2012 | Ohyama | | |

FOREIGN PATENT DOCUMENTS

| | | | |
|---|---|---|---|
| EP | 0961351 | A2 | 12/1999 |
| EP | 1414282 | A2 | 4/2004 |
| JP | 2005122901 | A | 5/2005 |
| JP | 2008166087 | A | 7/2008 |

* cited by examiner

CONNECTOR FOR OVERLAPPING TWO CIRCUIT BOARDS

BACKGROUND OF THE INVENTION

The present invention relates to a connector, particularly to a connector that enables a first circuit board having a first contact portion and a second circuit board having a second contact portion to be overlapped on each other to electrically connect the first contact portion and the second contact portion to each other.

As an exemplary connector used to connect two flat circuit boards that are overlapped on each other, JP 2005-122901 A discloses a connector for connecting a plurality of circuit conductors 2 arranged in a flexible printed circuit board (FPC) 1 with a plurality of flat conductors 4 in a flat cable 3 as shown in FIG. 16. This connector is composed of a connector body 5 and a plate member 6 that face each other so as to sandwich an overlap part where the FPC 1 and the flat cable 3 overlap. As shown in FIG. 17, the connector body 5 has a plurality of metallic penetrating pieces 7, while the plate member 6 has a plurality of receiving grooves 8 formed therein.

The flat cable 3 is placed on the surface of the FPC 1, and the connector body 5 and the plate member 6 are positioned with respect to the FPC 1 and the flat cable 3 such that the penetrating pieces 7 and the receiving grooves 8 separately correspond to the circuit conductors 2 of the FPC 1 and the flat conductors 4 of the flat cable 3. In this state, the penetrating pieces 7 of the connector body 5 are thrust into the overlap part where the FPC 1 and the flat cable 3 overlap, and accordingly, the circuit conductors 2 of the FPC 1 and the flat conductors 4 in the flat cable 3 are sheared by the penetrating pieces 7. Upon insertion of the penetrating pieces 7, sheared parts of the circuit conductors 2 and sheared parts of the flat conductors 4 come into contact with the metallic penetrating pieces 7. As a result, the circuit conductors 2 of the FPC 1 and the flat conductors 4 of the flat cable 3 are electrically connected via the penetrating pieces 7.

If, however, the FPC 1 and the flat cable 3 are overlapped in a wrong order, i.e., if the FPC 1 is placed on the surface of the flat cable 3, even when the penetrating pieces 7 of the connector body 5 are thrust into the overlap part where the FPC 1 and the flat cable 3 overlap, the circuit conductors 2 of the FPC 1 and the flat conductors 4 in the flat cable 3 may fail to establish their electrical connections.

In particular, when two circuit boards having similar shapes are overlapped and connected to each other, it becomes easy to mistake the order of overlapping the circuit boards.

SUMMARY OF THE INVENTION

The present invention has been made to overcome the conventional problem as above and aims at providing a connector that enables two circuit boards to be reliably overlapped in a proper order and electrically connected to each other.

A connector according to the present invention is one for overlapping a first circuit board having a first contact portion and a second circuit board having a second contact portion in a connecting direction to electrically connect the first contact portion and the second contact portion to each other, the connector comprising:

a flat plate portion; and one or more guide pins protrudingly formed on a surface of the flat plate portion, wherein each of the one or more guide pins includes a first fitting portion disposed on a root side of the guide pin and fitted with the first circuit board and a second fitting portion disposed on a tip side of the guide pin and fitted with the second circuit board, and the first fitting portion is larger in size than the second fitting portion in a direction perpendicular to the connecting direction

DETAILED DESCRIPTION OF THE INVENTION

Embodiments of the present invention are described below based on the appended drawings.

Embodiment 1

Figure 1:
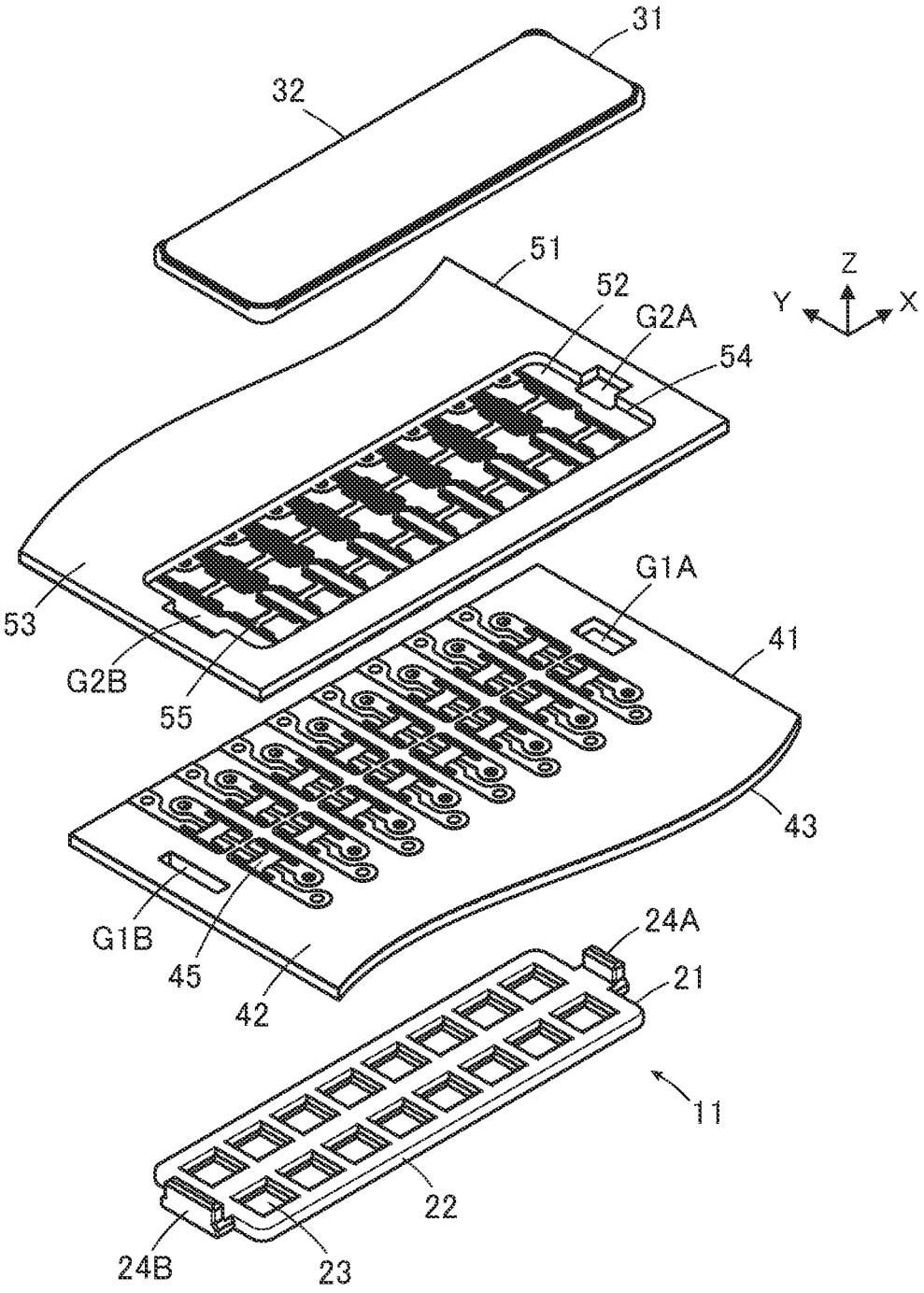
FIG. 1 is a perspective view of a first circuit board and a second circuit board disposed between a first connector portion and a second connector portion of a connector according to Embodiment 1 of the present invention, as seen from obliquely above.
Figure 2:
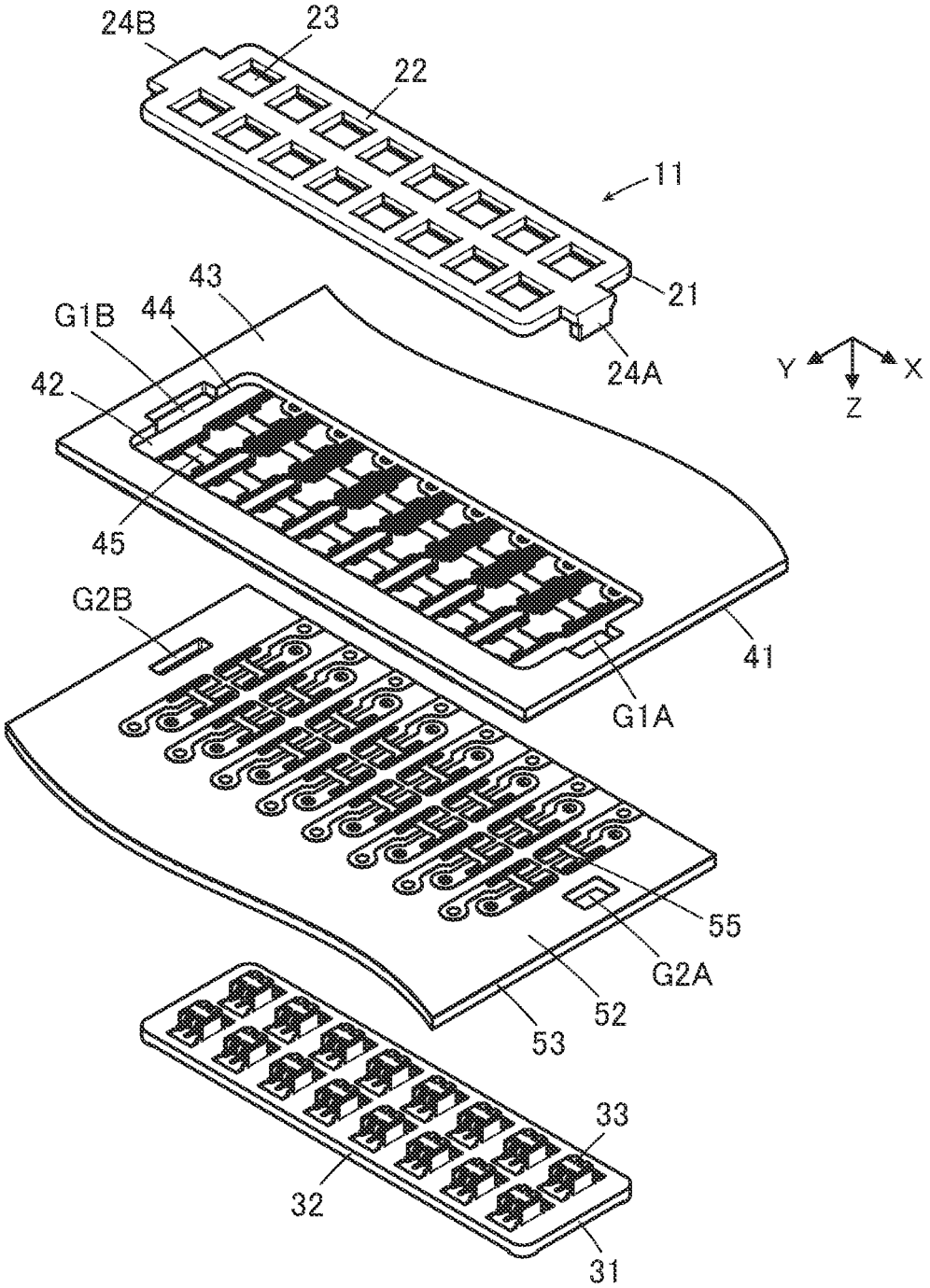
FIG. 2 is a perspective view of the first circuit board and the second circuit board disposed between the first connector portion and the second connector portion of the connector according to Embodiment 1, as seen from obliquely below.

FIGS. 1 and 2 show a connector 11 according to Embodiment 1 and a first circuit board 41 and a second circuit board 51 that are to be connected to each other by means of the connector 11, before assembling.

The connector 11 is composed of a first connector portion 21 and a second connector portion 31 that are detachable from each other. The first connector portion 21, the second connector portion 31, the first circuit board 41 and the second circuit board 51 are each a flat plate member and are arranged parallel to each other. The first circuit board 41 and the second circuit board 51 are sequentially arranged between the first connector portion 21 and the second connector portion 31.

The first connector portion 21 of the connector 11 includes a fitting plate (flat plate portion) 22 having insulation properties and a plurality of fitting holes 23 penetrating the fitting plate 22. The fitting holes 23 are arranged in two rows each having eight fitting holes 23 arranged at equal intervals. Thus, 16 fitting holes 23 are formed in total.

The first connector portion 21 further includes two guide pins 24A and 24B formed separately at the opposite ends of the fitting plate 22 to project in a direction perpendicular to the fitting plate 22.

As shown in FIG. 2, the second connector portion 31 of the connector 11 includes a base plate 32 having insulation properties and a plurality of projections 33 projecting on the surface of the base plate 32. Each projection 33 is formed from a metal spring and has elasticity. The projections 33 are arranged in two rows each having eight projections 33 arranged at equal intervals, and thus, 16 projections 33 are formed in total correspondingly to the 16 fitting holes 23 of the first connector portion 21.

For convenience, the first connector portion 21, the second connector portion 31, the first circuit board 41 and the second circuit board 51 are defined as extending along an XY plane, the direction in which eight fitting holes 23 are arranged in each row of the first connector portion 21 and eight projections 33 are arranged in each row of the second connector portion 31 is referred to as "X direction," the direction perpendicular to the X direction in an XY plane is referred to as "Y direction," and the direction from the first connector portion 21 to the second connector portion 31 is referred to as "+Z direction."

In the first connector portion 21, the guide pin 24A projects in the +Z direction from the +X directional end of the fitting plate 22, while the guide pin 24B projects in the +Z direction from the −X directional end of the fitting plate 22.

The projections 33 of the second connector portion 31 project in the −Z direction from the −Z direction-side surface of the base plate 32.

The first circuit board 41 includes a flexible first substrate 42 having insulation properties and a first reinforcement plate 43 joined to the −Z direction-side surface of the first substrate 42. The first reinforcement plate 43 has an opening 44 formed in the vicinity of its +Y directional end which penetrates the first reinforcement plate 43 and into which the fitting plate 22 of the first connector portion 21 is inserted. The first substrate 42 has a plurality of first through holes 45 of H shape arranged to be positioned within the opening 44 of the first reinforcement plate 43. The first through holes 45 are arranged in two rows each having eight first through holes 45 arranged in the X direction at equal intervals. Thus, 16 first through holes 45 are formed in total.

Further, the first circuit board 41 has first opening portions G1A and G1B formed separately at the +X and −X directional ends of the opening 44 of the first reinforcement plate 43, each of the first opening portions G1A and G1B being a hole penetrating both the first substrate 42 and the first reinforcement plate 43.

Figure 3:
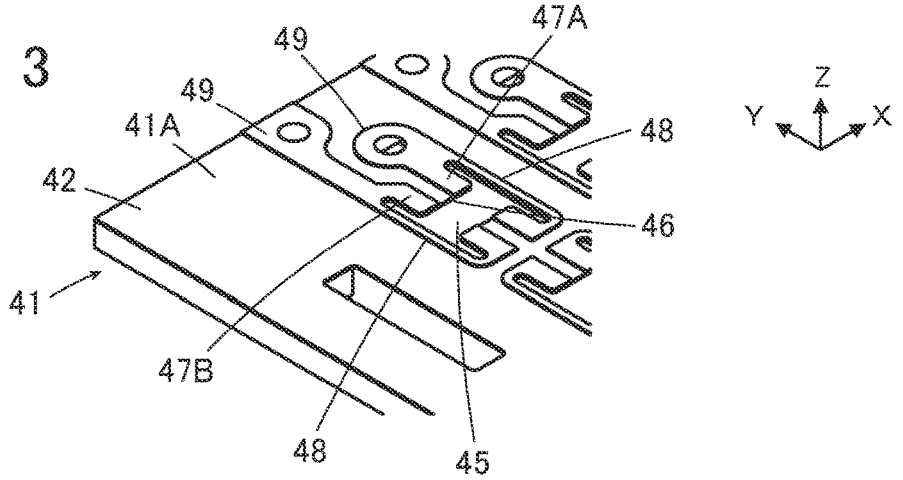
FIG. 3 is an enlarged partial perspective view of the first circuit board.

As shown in FIG. 3, a pair of first protruding pieces 46 constituted of part of the flexible first substrate 42 are formed in each first through hole 45 of the first circuit board 41. A pair of first contact portions 47A and a pair of first contact portions 47B are formed on the pair of first protruding pieces 46 on a surface 41A, facing in the +Z direction, of the first circuit board 41. The pair of first contact portions 47A are electrically interconnected by a conductive portion 48 formed at the +X direction-side edge of the first through hole 45, while the pair of first contact portions 47B are electrically interconnected by a conductive portion 48 formed at the −X direction-side edge of the first through hole 45. The conductive portion 48 connecting the pair of first contact portions 47A and the conductive portion 48 connecting the pair of first contact portions 47B are each connected to a pad portion 49.

As shown in FIGS. 1 and 2, the second circuit board 51 includes a flexible second substrate 52 having insulation properties and a second reinforcement plate 53 joined to the +Z direction-side surface of the second substrate 52. The second reinforcement plate 53 has an opening 54 formed in the vicinity of its −Y directional end which penetrates the second reinforcement plate 53 and into which the base plate 32 of the second connector portion 31 is inserted. The second substrate 52 has a plurality of second through holes 55 of H shape arranged to be positioned within the opening 54 of the second reinforcement plate 53. The second through holes 55 are arranged in two rows each having eight second through holes 55 arranged in the X direction at equal intervals. Thus, 16 second through holes 55 are formed in total.

Further, the second circuit board 51 has second opening portions G2A and G2B formed separately at the +X and −X directional ends of the opening 54 of the second reinforcement plate 53, each of the second opening portions G2A and G2B being a hole penetrating both the second substrate 52 and the second reinforcement plate 53.

Figure 4:
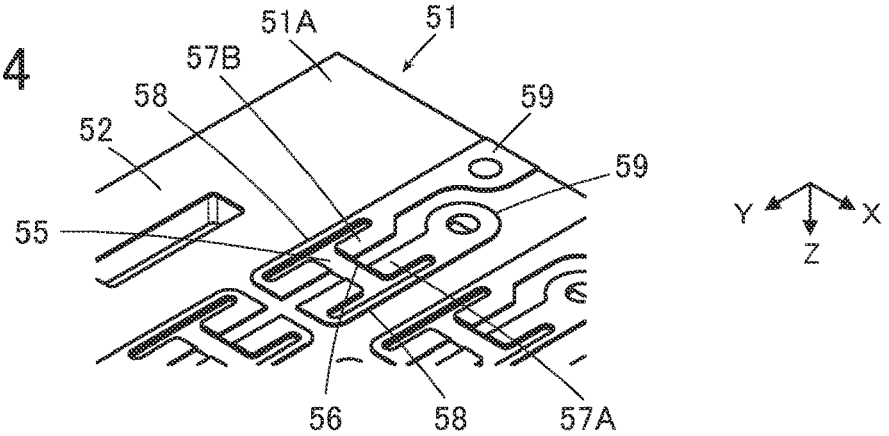
FIG. 4 is an enlarged partial perspective view of the second circuit board.

As shown in FIG. 4, a pair of second protruding pieces 56 constituted of part of the flexible second substrate 52 are formed in each second through hole 55 of the second circuit board 51. A pair of second contact portions 57A and a pair of second contact portions 57B are formed on the pair of second protruding pieces 56 on a surface 51A, facing in the −Z direction, of the second circuit board 51. The pair of second contact portions 57A are electrically interconnected by a conductive portion 58 formed at the +X direction-side edge of the second through hole 55, while the pair of second contact portions 57B are electrically interconnected by a conductive portion 58 formed at the −X direction-side edge of the second through hole 55. The conductive portion 58 connecting the pair of second contact portions 57A and the conductive portion 58 connecting the pair of second contact portions 57B are each connected to a pad portion 59.

Figure 5:
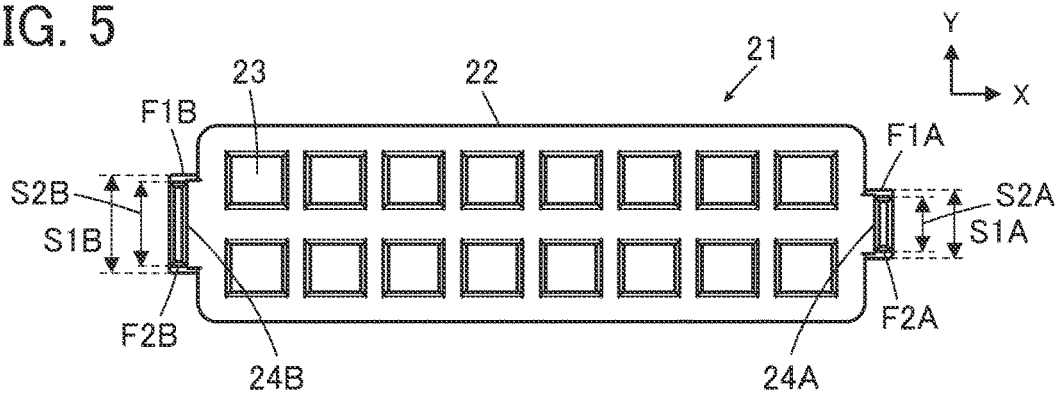
FIG. 5 is a plan view showing the first connector portion.
Figure 6:
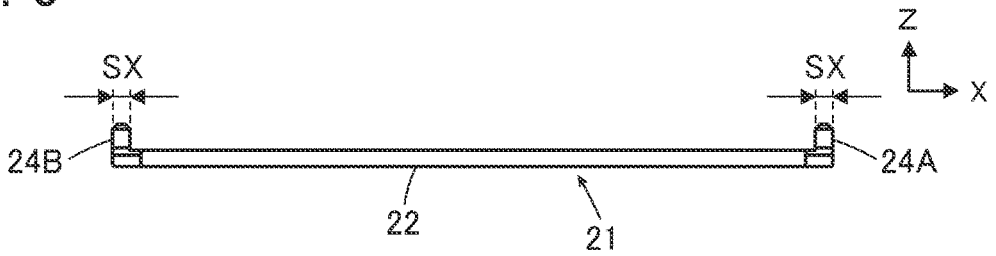
FIG. 6 is a front view showing the first connector portion.
Figure 7:
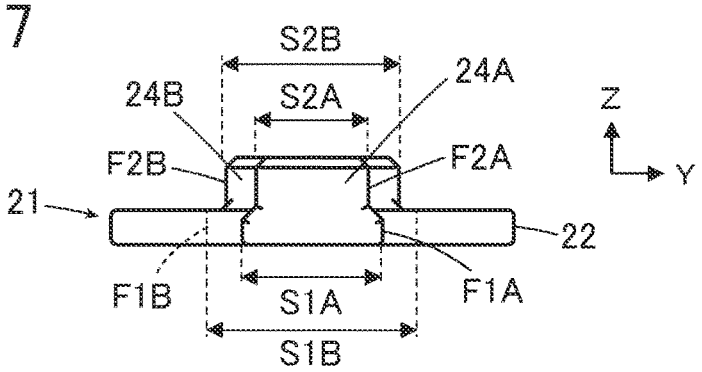
FIG. 7 is a side view showing the first connector portion.

As shown in FIGS. 5 to 7, the guide pin 24A projecting in the +Z direction from the +X directional end of the fitting plate 22 of the first connector portion 21 has such a shape that the width of the guide pin 24A in the Y direction varies in two stages as advancing in the +Z direction. The guide pin 24A includes a first fitting portion F1A disposed on the root side, i.e., the −Z direction side of the guide pin 24A and a second fitting portion F2A disposed on the tip side, i.e., the +Z direction side thereof. A width S1A of the first fitting portion F1A is larger than a width S2A of the second fitting portion F2A in the Y direction perpendicular to the Z direction.

When the first circuit board 41 and the second circuit board 51 are connected using the connector 11, the guide pin 24A of the first connector portion 21 is inserted into the first opening portion G1A of the first circuit board 41 and the second opening portion G2A of the second circuit board 51, and at this time, the first fitting portion F1A of the guide pin 24A is fitted in the first opening portion G1A of the first circuit board 41, while the second fitting portion F2A of the guide pin 24A is fitted in the second opening portion G2A of the second circuit board 51.

Likewise, the guide pin 24B projecting in the +Z direction from the −X directional end of the fitting plate 22 has such a shape that the width of the guide pin 24B in the Y direction varies in two stages as advancing in the +Z direction. The guide pin 24B includes a first fitting portion F1B disposed on the root side, i.e., the −Z direction side of the guide pin 24B and a second fitting portion F2B disposed on the tip side, i.e., the +Z direction side thereof. A width S1B of the first fitting portion F1B is larger than a width S2B of the second fitting portion F2B in the Y direction perpendicular to the Z direction.

When the first circuit board 41 and the second circuit board 51 are connected using the connector 11, the guide pin 24B of the first connector portion 21 is inserted into the first opening portion G1B of the first circuit board 41 and the second opening portion G2B of the second circuit board 51, and at this time, the first fitting portion F1B of the guide pin 24B is fitted in the first opening portion G1B of the first circuit board 41, while the second fitting portion F2B of the guide pin 24B is fitted in the second opening portion G2B of the second circuit board 51.

The width S2B, in the Y direction, of the second fitting portion F2B of the guide pin 24B formed at the −X directional end of the fitting plate 22 is larger then the width S1A, in the Y direction, of the first fitting portion F1A of the guide pin 24A formed at the +X directional end of the fitting plate 22. The widths S1A, S1B, S2A and S2B satisfy Inequality (1) below.

$$S2A<S1A<S2B<S1B \quad (1)$$

As shown in FIG. 6, the guide pins 24A and 24B have the same thickness SX in the X direction.

Figure 8:
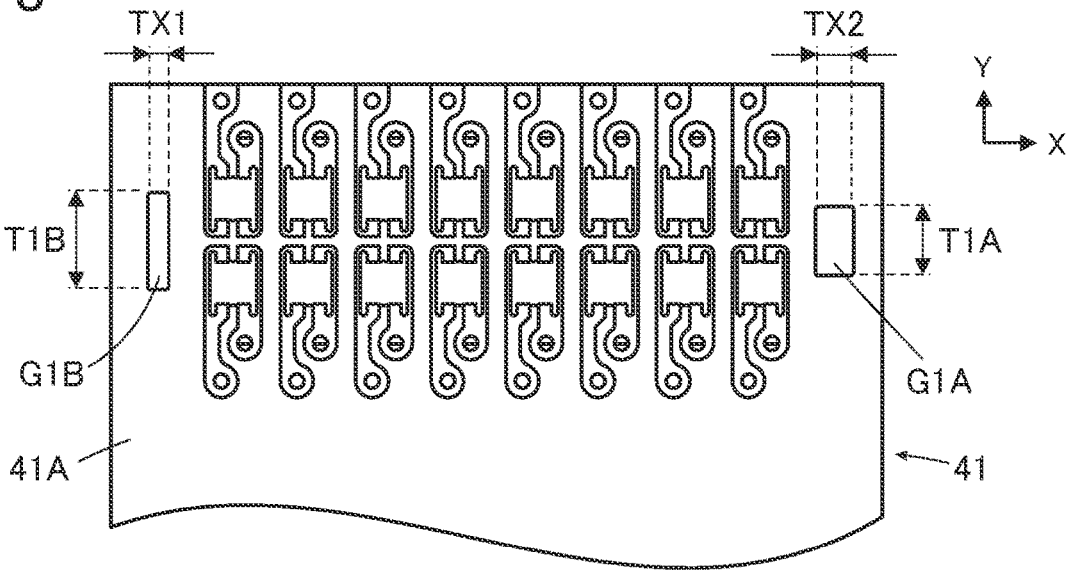
FIG. 8 is a view showing a top surface of the first circuit board.
Figure 9:
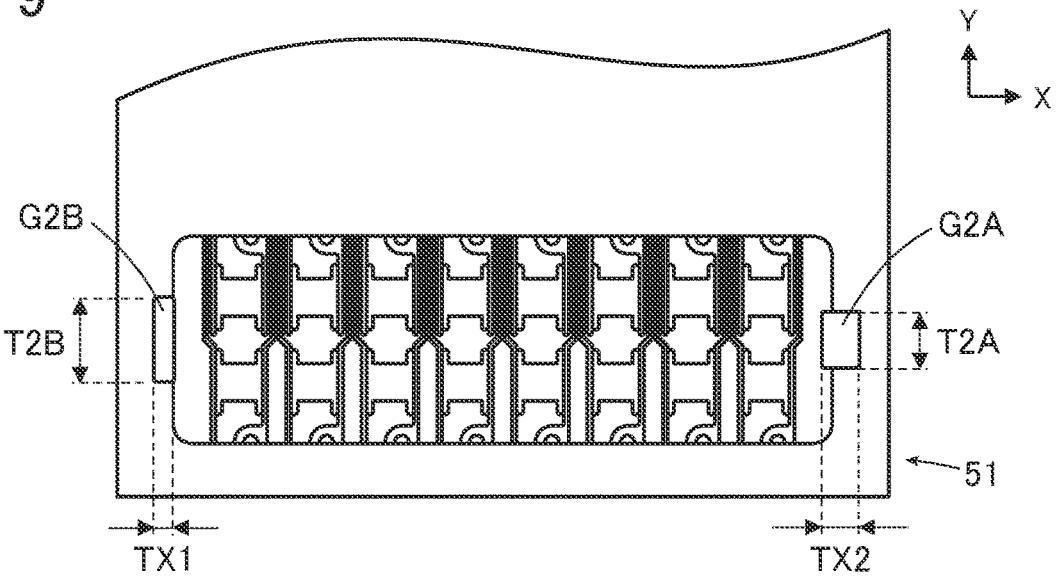
FIG. 9 is a view showing a bottom surface of the second circuit board.

As shown in FIGS. 8 and 9, a width T1A, in the Y direction, of the first opening portion G1A formed at the +X directional end of the first circuit board 41 is larger than a width T2A, in the Y direction, of the second opening portion G2A formed at the +X directional end of the second circuit board 51, and a width T1B, in the Y direction, of the first opening portion G1B formed at the −X directional end of the first circuit board 41 is larger than a width T2B, in the Y direction, of the second opening portion G2B formed at the −X directional end of the second circuit board 51.

In addition, the width T1A, in the Y direction, of the first opening portion G1A formed at the +X directional end of the first circuit board 41 is smaller than the width T2B, in the Y direction, of the second opening portion G2B formed at the −X directional end of the second circuit board 51. The widths T1A, T1B, T2A and T2B satisfy Inequality (2) below.

$$T2A<T1A<T2B<T1B \quad (2)$$

The width T2A, in the Y direction, of the second opening portion G2A formed at the +X directional end of the second circuit board 51 is equal to or larger than the width S2A, in the Y direction, of the second fitting portion F2A of the guide pin 24A disposed at the +X directional end of the fitting plate 22 and smaller than the width S1A, in the Y direction, of the first fitting portion F1A of the guide pin 24A disposed at the +X directional end of the fitting plate 22.

The width T1A, in the Y direction, of the first opening portion G1A formed at the +X directional end of the first circuit board 41 is equal to or larger than the width S1A, in the Y direction, of the first fitting portion F1A of the guide pin 24A disposed at the +X directional end of the fitting plate 22 and smaller than the width S2B, in the Y direction, of the second fitting portion F2B of the guide pin 24B disposed at the −X directional end of the fitting plate 22.

The width T2B, in the Y direction, of the second opening portion G2B formed at the −X directional end of the second circuit board 51 is equal to or larger than the width S2B, in the Y direction, of the second fitting portion F2B of the guide pin 24B disposed at the −X directional end of the fitting plate 22 and smaller than the width S1B, in the Y direction, of the first fitting portion F1B of the guide pin 24B disposed at the −X directional end of the fitting plate 22.

The width T1B, in the Y direction, of the first opening portion G1B formed at the −X directional end of the first circuit board 41 is equal to or larger than the width S1B, in the Y direction, of the first fitting portion F1B of the guide pin 24B disposed at the −X directional end of the fitting plate 22.

In other words, the width S1A of the first fitting portion F1A and the width S2A of the second fitting portion F2A of the guide pin 24A, the width S1B of the first fitting portion F1B and the width S2B of the second fitting portion F2B of the guide pin 24B, the width T1A of the first opening portion G1A and the width T1B of the first opening portion G1B of the first circuit board 41, and the width T2A of the second opening portion G2A and the width T2B of the second opening portion G2B of the second circuit board 51 satisfy Inequality (3) below.

$$S2A\leq T2A<S1A\leq T1A<S2B\leq T2B<S1B\leq T1B \quad (3)$$

As shown in FIGS. 8 and 9, the first opening portion G1B of the first circuit board 41 and the second opening portion G2B of the second circuit board 51 each have a width TX1 in the X direction that is slightly larger than the thickness SX, in the X direction, of each of the guide pins 24A and 24B. On the other hand, the first opening portion G1A of the first circuit board 41 and the second opening portion G2A of the second circuit board 51 each have a width TX2 in the X direction that is larger than the width TX1, in the X direction, of each of the first opening portion G1B of the first circuit board 41 and the second opening portion G2B of the second circuit board 51.

Next, the method of connecting the first circuit board 41 and the second circuit board 51 using the connector 11 according to Embodiment 1 is described.

Figure 10:
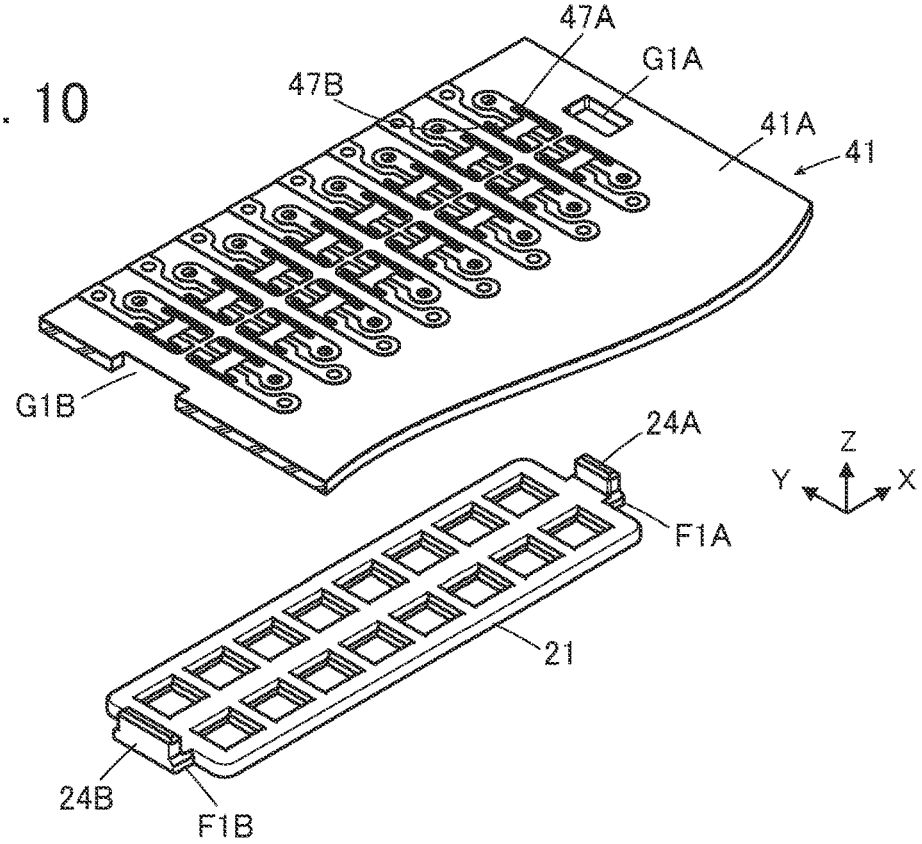
FIG. 10 is a partially broken perspective view showing the state where the first circuit board is positioned with respect to the first connector portion.

First, as shown in FIG. 10, the first circuit board 41 is placed on the +Z direction side of the first connector portion 21, and the first connector portion 21 and the first circuit board 41 are positioned with respect to each other. At this time, the first connector portion 21 and the first circuit board 41 are arranged such that the surface 41A of the first circuit board 41 on which the first contact portions 47A and 47B are formed faces in the +Z direction and that the first opening portions G1A and G1B of the first circuit board 41 are respectively positioned right above the guide pins 24A and 24B of the first connector portion 21.

Note that, in FIG. 10, the −X directional end of the first circuit board 41 is cut along a YZ plane in order to clearly show the relationship between the first fitting portion F1B of the guide pin 24B of the first connector portion 21 and the first opening portion G1B of the first circuit board 41.

Figure 11:
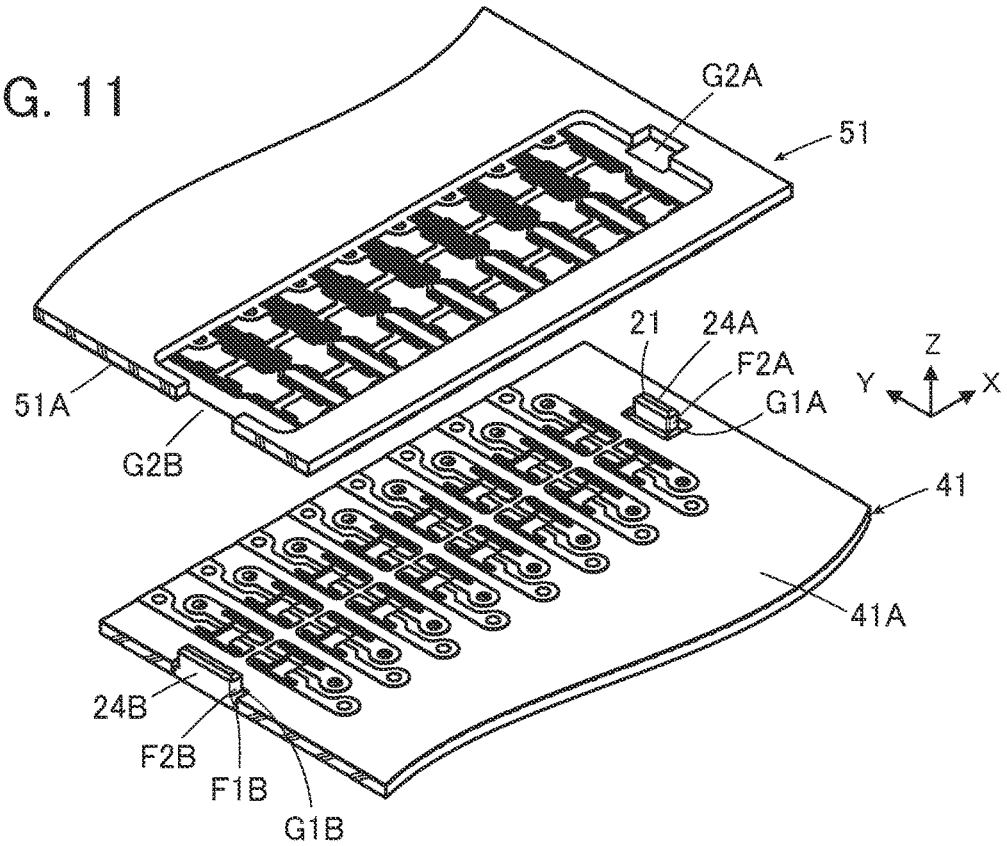
FIG. 11 is a partially broken perspective view showing the state where the second circuit board is positioned with respect to the first connector portion fitted with the first circuit board.

In this state, the first circuit board 41 is relatively translated in the −Z direction toward the first connector portion 21, and as shown in FIG. 11, the first fitting portions F1A and F1B formed on the root side of the guide pins 24A and 24B of the first connector portion 21 are fitted into the first opening portions G1A and G1B of the first circuit board 41, respectively. Since, as represented by Inequality (3) above, the widths T1A and T1B, in the Y direction, of the first opening portions G1A and G1B of the first circuit board 41 are respectively equal to or larger than the widths S1A and S1B, in the Y direction, of the first fitting portions F1A and F1B of the guide pins 24A and 24B, the first fitting portions F1A and F1B can smoothly be fitted into the first opening portions G1A and G1B.

Note that, in FIG. 11, the −X directional ends of the first circuit board 41 and the second circuit board 51 are cut along a YZ plane in order to clearly show the relationship between the first fitting portion F1B and the second fitting portion F2B of the guide pin 24B of the first connector portion 21, the first opening portion G1B of the first circuit board 41, and the second opening portion G2B of the second circuit board 51.

In the above, if the order of the first circuit board 41 and the second circuit board 51 is incorrect, that is, if the second circuit board 51 is translated from the +Z direction side toward the first connector portion 21 so as to insert the guide pins 24A and 24B of the first connector portion 21 into the second opening portions G2A and G2B of the second circuit board 51, since, as represented by Inequality (3) above, the widths T2A and T2B, in the Y direction, of the second opening portions G2A and G2B are respectively smaller than the widths S1A and S1B, in the Y direction, of the first fitting portions F1A and F1B formed on the root side of the guide pins 24A and 24B, the first fitting portions F1A and F1B cannot be fitted in the second opening portions G2A and G2B of the second circuit board 51.

Alternatively, if the orientation of the first circuit board 41 in an XY plane is incorrect, that is, if the first circuit board 41 is translated toward the first connector portion 21 so as to insert the guide pins 24B and 24A of the first connector portion 21 into the first opening portions G1A and G1B of the first circuit board 41 with the first opening portion G1A being positioned on the −X directional end side and the first opening portion G1B being positioned on the +X directional end side, since, as represented by Inequality (3) above, the width T1A, in the Y direction, of the first opening portion G1A of the first circuit board 41 is smaller than the width S1B, in the Y direction, of the first fitting portion F1B formed on the root side of the guide pin 24B, the first fitting portion F1B of the guide pin 24B cannot be fitted in the first opening portion G1A of the first circuit board 41.

Thus, it is possible to prevent the first circuit board 41 and the second circuit board 51 from being disposed on the first connector portion 21 in a wrong order and prevent the first circuit board 41 from being arranged on the first connector portion 21 in a wrong orientation.

By fitting the first fitting portions F1A and F1B of the guide pins 24A and 24B into the first opening portions G1A and G1B of the first circuit board 41, the fitting plate 22 of the first connector portion 21 is inserted into the opening 44 formed in the first reinforcement plate 43 of the first circuit board 41.

At this time, the first fitting portions F1A and F1B of the guide pins 24A and 24B are accommodated in the first opening portions G1A and G1B of the first circuit board 41 and do not protrude in the +Z direction from the surface 41A of the first circuit board 41, while the second fitting portions F2A and F2B formed on the tip side of the guide pins 24A and 24B pass through the first opening portions G1A and G1B of the first circuit board 41 and protrude in the +Z direction from the surface 41A of the first circuit board 41.

Now, as shown in FIG. 11, the second circuit board 51 is placed on the +Z direction side of the first circuit board 41, and the first connector portion 21 and the second circuit board 51 are positioned with respect to each other. At this time, the second circuit board 51 is positioned with respect to the first connector portion 21 such that the surface 51A of the second circuit board 51 on which the second contact portions 57A and 57B are formed faces in the −Z direction and that the second opening portions G2A and G2B of the second circuit board 51 are respectively positioned right above the guide pins 24A and 24B of the first connector portion 21.

Figure 12:
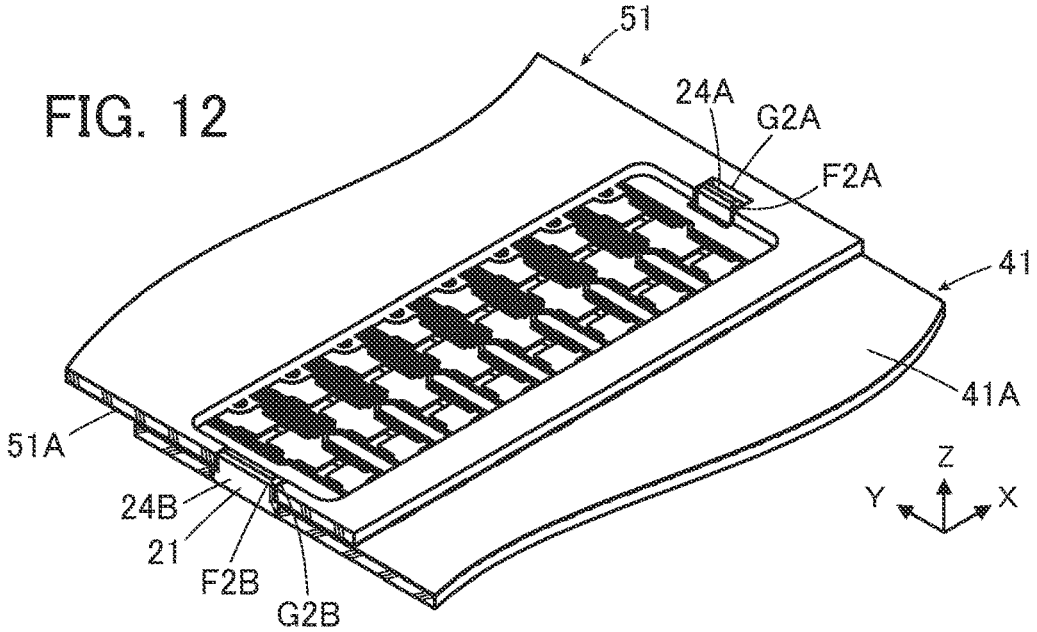
FIG. 12 is a partially broken perspective view showing the state where the first connector portion is fitted with the first circuit board and the second circuit board.

In this state, the second circuit board 51 is relatively translated in the −Z direction toward the first connector portion 21 and the first circuit board 41, and as shown in FIG. 12, the second fitting portions F2A and F2B formed on the tip side of the guide pins 24A and 24B of the first connector portion 21 are fitted into the second opening portions G2A and G2B of the second circuit board 51, respectively. Since, as represented by Inequality (3) above, the widths T2A and T2B, in the Y direction, of the second opening portions G2A and G2B of the second circuit board 51 are respectively equal to or larger than the widths S2A and S2B, in the Y direction, of the second fitting portions F2A and F2B of the guide pins 24A and 24B, the second fitting portions F2A and F2B can smoothly be fitted into the second opening portions G2A and G2B.

Note that, in FIG. 12, the −X directional ends of the first circuit board 41 and the second circuit board 51 are cut along a YZ plane in order to clearly show the relationship between the second fitting portion F2B of the guide pin 24B of the first connector portion 21 and the second opening portion G2B of the second circuit board 51.

In the above, if the orientation of the second circuit board 51 in an XY plane is incorrect, that is, if the second circuit board 51 is translated toward the first connector portion 21 so as to insert the guide pins 24B and 24A of the first connector portion 21 into the second opening portions G2A and G2B of the second circuit board 51 with the second opening portion G2A being positioned on the −X directional end side and the second opening portion G2B being positioned on the +X directional end side, since, as represented by Inequality (3) above, the width T2A, in the Y direction, of the second opening portion G2A of the second circuit board 51 is smaller than the width S2B, in the Y direction, of the second fitting portion F2B formed on the tip side of the guide pin 24B, the second fitting portion F2B of the guide pin 24B cannot be fitted in the second opening portion G2A of the second circuit board 51.

Thus, it is possible to prevent the second circuit board 51 from being disposed on the first connector portion 21 in a wrong orientation.

By fitting the second fitting portions F2A and F2B of the guide pins 24A and 24B into the second opening portions G2A and G2B of the second circuit board 51, the second circuit board 51 is overlapped on the first circuit board 41 such that the surface 51A of the second circuit board 51 faces the surface 41A of the first circuit board 41.

The connector 11 is configured such that, at this time, the tips of the guide pins 24A and 24B are disposed within the thickness range of the second circuit board 51 and the second fitting portions F2A and F2B of the guide pins 24A and 24B do not protrude in the +Z direction from the second circuit board 51. With this configuration, the connector 11 can be reduced in thickness.

After the first circuit board 41 and the second circuit board 51 are overlapped on each other on the first connector portion 21 as shown in FIG. 12, the second connector portion 31 shown in FIGS. 1 and 2 is relatively moved in the −Z direction toward the first connector portion 21 so as to allow the projections 33 of the second connector portion 31 to sequentially pass through the second through holes 55 of the second circuit board 51 and the first through holes 45 of the first circuit board 41 and then fit into the fitting holes 23 of the first connector portion 21. Thus, the first connector portion 21 and the second connector portion 31 are fitted with each other.

When the projections 33 of the second connector portion 31 are fitted into the fitting holes 23 of the first connector portion 21 through the first through holes 45 of the first circuit board 41 and the second through holes 55 of the second circuit board 51, the pairs of first protruding pieces 46 protruding in the first through holes 45 of the first circuit board 41 and the pairs of second protruding pieces 56 protruding in the second through holes 55 of the second circuit board 51 are pushed in the −Z direction by the projections 33 and bent in the −Z direction in the fitting holes 23 of the first connector portion 21. Then, the pair of first contact portions 47A formed at each pair of first protruding pieces 46 of the first circuit board 41 and the pair of second contact portions 57A formed at the corresponding pair of second protruding pieces 56 of the second circuit board 51 are opposed to and overlapped on each other, elastically pressed against each other to establish their contact between the lateral surface of the projection 33 and the inner surface of the fitting hole 23 by the aid of the elastic projection 33, and reliably electrically connected to each other.

Likewise, the pair of first contact portions 47B formed at each pair of first protruding pieces 46 of the first circuit board 41 and the pair of second contact portions 57B formed at the corresponding pair of second protruding pieces 56 of the second circuit board 51 are opposed to and overlapped on each other, elastically pressed against each other to establish their contact between the lateral surface of the projection 33 and the inner surface of the fitting hole 23 by the aid of the elastic projection 33, and electrically connected to each other.

Thus, the connected state between the first circuit board 41 and the second circuit board 51 is established.

As described above, the use of the connector 11 enables the first circuit board 41 and the second circuit board 51 to be reliably overlapped in a proper order and electrically connected to each other.

As described above, the first opening portion G1B of the first circuit board 41 and the second opening portion G2B of the second circuit board 51 each have the width TX1 in the X direction that is slightly larger than the thickness SX, in the X direction, of each of the guide pins 24A and 24B; therefore, by fitting the guide pin 24B in the first opening portion G1B of the first circuit board 41 and the second opening portion G2B of the second circuit board 51, the first circuit board 41 and the second circuit board 51 can be positioned with respect to the first connector portion 21 in the X direction.

The first opening portion G1A of the first circuit board 41 and the second opening portion G2A of the second circuit board 51 each have the width TX2 in the X direction that is larger than the width TX1, in the X direction, of each of the first opening portion G1B of the first circuit board 41 and the second opening portion G2B of the second circuit board 51. Accordingly, even when the first connector portion 21, the first circuit board 41 and the second circuit board 51 vary in size within predetermined production tolerances, the guide pin 24A can be fitted in the first opening portion G1A of the first circuit board 41 and the second opening portion G2A of the second circuit board 51.

While, in Embodiment 1 above, the first connector portion 21 has the two guide pins 24A and 24B, the first circuit board 41 and the second circuit board 51 can be prevented from being overlapped on the first connector portion 21 in a wrong order even with only one guide pin.

More specifically, it is assumed that, for instance, the first connector portion 21 has only one guide pin, the first circuit board 41 has one first opening portion, the second circuit board 51 has one second opening portion, and as with Inequality (3) above, widths S1 and S2, in the Y direction, of a first fitting portion on the root side of the guide pin and a second fitting portion on the tip side thereof, a width T1, in the Y direction, of the first opening portion of the first circuit board 41, and a width T2, in the Y direction, of the second opening portion of the second circuit board 51 satisfy the relationship:

$$S2 \leq T2 < S1 \leq T1 \quad (4)$$

In this case, if the order of the first circuit board 41 and the second circuit board 51 is incorrect, that is, if the guide pin of the first connector portion 21 is attempted to be inserted into the second opening portion of the second circuit board 51, since the width T2, in the Y direction, of the second opening portion is smaller than the width S1, in the Y direction, of the first fitting portion formed on the root side of the guide pin, the first fitting portion cannot be fitted in the second opening portion of the second circuit board 51.

Thus, it is possible to prevent the first circuit board 41 and the second circuit board 51 from being overlapped on the first connector portion 21 in a wrong order.

A lock mechanism for locking the second connector portion 31 may be provided at the +Z directional ends of the guide pins 24A and 24B of the first connector portion 21. Provision of such a lock mechanism enables to lock the fitted state between the first connector portion 21 and the second connector portion 31 and maintain the connected state between the first circuit board 41 and the second circuit board 51.

While, in Embodiment 1, the guide pins 24A and 24B are formed in the first connector portion 21, the invention is not limited thereto; even when the guide pins 24A and 24B are formed in the second connector portion 31, the first circuit board 41 and the second circuit board 51 can be reliably overlapped in a proper order and electrically connected to each other in the same manner.

While, in Embodiment 1, the projections 33 of the second connector portion 31 have elasticity, the invention is not limited thereto; even when the fitting holes 23 of the first connector portion 21 have elasticity and the projections 33 of the second connector portion 31 have excellent rigidity, the first connector portion 21 and the second connector portion 31 can be fitted with each other to establish the connected state between the first circuit board 41 and the second circuit board 51 by fitting the projections 33 of the second connector portion 31 in the fitting holes 23 of the first connector portion 21 through the first through holes 45 of the first circuit board 41 and the second through holes 55 of the second circuit board 51.

Embodiment 2

Figure 13:
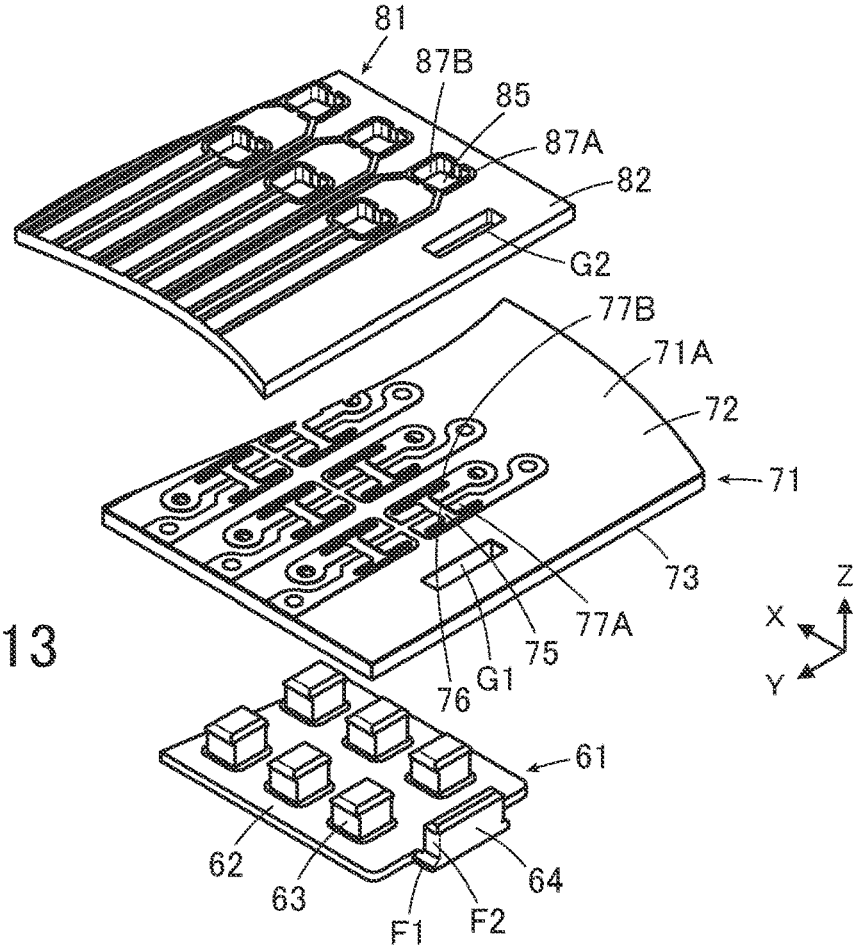
FIG. 13 is a perspective view showing the state where a first circuit board and a second circuit board are positioned with respect to a connector according to Embodiment 2.

FIG. 13 shows a connector 61 according to Embodiment 2 and a first circuit board 71 and a second circuit board 81 that are to be connected to each other by means of the connector 61.

The connector 61 includes a base plate (flat plate portion) 62 having insulation properties and a plurality of projections 63 protrudingly formed on the surface of the base plate 62 facing in the +Z direction. The projections 63 are made of an insulating material such as insulating rubber for example and have elasticity at least in the Y direction.

The connector 61 has a guide pin 64 protrudingly formed in the +Z direction from an end of the base plate 62.

The guide pin 64 includes a first fitting portion F1 disposed on the root side, i.e., the −Z direction side of the guide pin 64 and a second fitting portion F2 disposed on the tip side, i.e., the +Z direction side thereof. A width of the first fitting portion F1 is larger than a width of the second fitting portion F2 in the Y direction perpendicular to the Z direction.

The first circuit board 71 has the same structure as that of the first circuit board 41 used in Embodiment 1. Specifically, the first circuit board 71 includes a flexible first substrate 72 having insulation properties and a first reinforcement plate 73 joined to the −Z direction-side surface of the first substrate 72. The first substrate 72 has a plurality of first through holes 75 of H shape. A pair of first protruding pieces 76 constituted of part of the flexible first substrate 72 are formed in each first through hole 75, and a pair of first contact portions 77A and a pair of first contact portions 77B are formed on the pair of first protruding pieces 76 on a surface 71A of the first circuit board 71 that faces in the +Z direction.

Further, the first circuit board 71 has a first opening portion G1 formed at its one end that is formed of a hole penetrating both the first substrate 72 and the first reinforcement plate 73.

The second circuit board 81 includes a second substrate 82 having insulation properties and rigidity and a plurality of circular through holes 85 penetrating the second substrate 82 in the Z direction. The through holes 85 have a substantially rectangular planar shape, and a pair of second contact portions 87A and 87B that are electrically insulated from each other are formed on the inner surface of each through hole 85.

Further, the second circuit board 81 has a second opening portion G2 formed at its one end that is formed of a hole penetrating the second substrate 82.

The first opening portion G1 of the first circuit board 71 has a width in the Y direction that is equal to or larger than the width, in the Y direction, of the first fitting portion F1 of the guide pin 64, and the second opening portion G2 of the second circuit board 81 has a width in the Y direction that is equal to or larger than the width, in the Y direction, of the second fitting portion F2 of the guide pin 64 and smaller than the width, in the Y direction, of the first fitting portion F1.

When the first circuit board 71 and the second circuit board 81 are connected using the connector 61, first, as shown in FIG. 13, the first circuit board 71 is placed on the +Z direction side of the connector 61, while the second circuit board 81 is placed on the +Z direction side of the first circuit board 71. At this time, the first circuit board 71 is positioned such that the surface 71A on which the first contact portions 77A and 77B are formed faces in the +Z direction.

In this state, the first circuit board 71 and the second circuit board 81 are relatively translated in the −Z direction toward the connector 61 to fit the first fitting portion F1 formed on the root side of the guide pin 64 of the connector 61 into the first opening portion G1 of the first circuit board 71 and fit the second fitting portion F2 formed on the tip side of the guide pin 64 into the second opening portion G2 of the second circuit board 81. At this time, since the first opening portion G1 of the first circuit board 71 has the width in the Y direction that is equal to or larger than the width, in the Y direction, of the first fitting portion F1 of the guide pin 64 and the second opening portion G2 of the second circuit board 81 has the width in the Y direction that is equal to or larger than the width, in the Y direction, of the second fitting portion F2 of the guide pin 64, the first fitting portion F1 and the second fitting portion F2 of the guide pin 64 can smoothly be fitted into the first opening portion G1 of the first circuit board 71 and the second opening portion G2 of the second circuit board 81, respectively.

Along with fitting the first fitting portion F1 and the second fitting portion F2 of the guide pin 64 into the first opening portion G1 of the first circuit board 71 and the second opening portion G2 of the second circuit board 81, the projections 63 of the connector 61 pass through the first through holes 75 of the first circuit board 71 in the +Z direction and then are fitted into the through holes 85 of the second circuit board 81.

When the projection 63 of the connector 61 passes through the first through hole 75 of the first circuit board 71 in the +Z direction, the pair of first protruding pieces 76 protruding in the first through hole 75 are bent in the +Z direction and each sandwiched between the lateral surface of the projection 63 of the connector 61 and the inner surface of the through hole 85 of the second circuit board 81. Accordingly, the first contact portions 77A and 77B formed on the surfaces of the first protruding pieces 76 are elastically pressed against and come into contact with the second contact portions 87A and 87B formed on the inner surface of the through hole 85 of the second circuit board 81, and are thereby electrically connected with the second contact portions 87A and 87B, respectively.

In the above, if the order of the first circuit board 71 and the second circuit board 81 is incorrect, that is, if the second circuit board 81 is translated from the +Z direction side toward the connector 61 to insert the guide pin 64 of the connector 61 into the second opening portion G2 of the second circuit board 81, since the width, in the Y direction, of the second opening portion G2 is smaller than the width, in the Y direction, of the first fitting portion F1 formed on the root side of the guide pin 64, the first fitting portion F1 cannot be fitted in the second opening portion G2 of the second circuit board 81.

Therefore, the use of the connector 61 according to Embodiment 2 also enables to prevent the first circuit board 71 and the second circuit board 81 from being disposed on the connector 61 in a wrong order and establish the connected state between the first circuit board 71 and the second circuit board 81.

Also in Embodiment 2, as with Embodiment 1, the connector 61 may be configured such that the connector 61 includes two guide pins 64 protrudingly formed at the opposite ends, in the X direction, of the base plate 62, the first circuit board 71 has two first opening portions G1 formed at its opposite ends in the X direction, and the second circuit board 81 has two second opening portions G2 formed at its opposite ends in the X direction. When the first fitting portions F1 and the second fitting portions F2 of the two guide pins 64, the two first opening portions G1 and the two second opening portions G2 have Y directional widths satisfying the size relationship represented by Inequality (3) above, it is possible to prevent the first circuit board 71 and the second circuit board 81 from being arranged not only in a wrong order but also in wrong orientations.

Embodiment 3

In Embodiment 1 above, as shown in FIG. 5, the two guide pins 24A and 24B of the first connector portion 21 are disposed on the center line of the fitting plate 22 extending in the X direction, that is, the center of the guide pin 24A and the center of the guide pin 24B are in the same position in the Y direction; however, the invention is not limited thereto.

Figure 14:
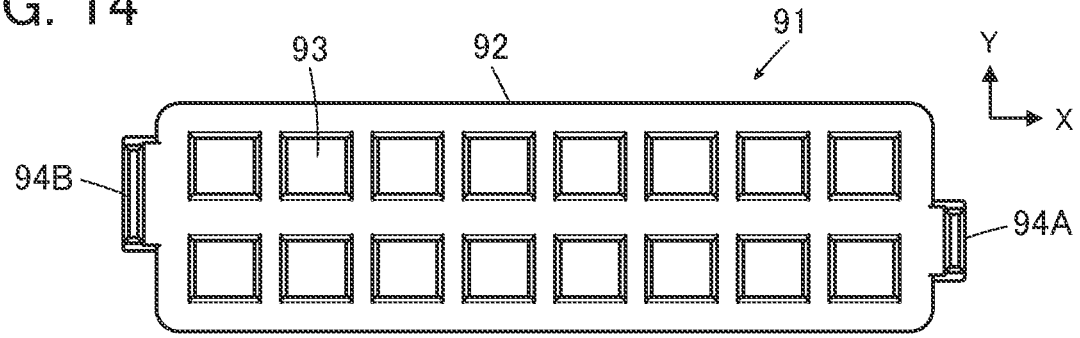
FIG. 14 is a plan view showing a first connector portion used in a connector according to Embodiment 3.

FIG. 14 is a plan view of a first connector portion 91 used in Embodiment 3, as viewed in the Z direction. The first connector portion 91 includes a fitting plate 92 having fitting holes 93 that are arranged in two rows each having eight fitting holes 93 arranged in the X direction, the two rows being arranged in the Y direction. Guide pins 94A and 94B are formed in the fitting plate 92 separately at its opposite ends in the X direction.

The two guide pins 94A and 94B are in different positions in the Y direction perpendicular to the direction in which each eight fitting holes 93 are arranged, hole the guide pin 94A disposed at the +X directional end of the fitting plate 92 is disposed on a relatively −Y directional side of the fitting plate 92, while the guide pin 94B disposed at the −X directional end of the fitting plate 92 is disposed on a relatively +Y directional side of the fitting plate 92.

Although not illustrated, a first circuit board and a second circuit board to be connected by the connector according to Embodiment 3 have first opening portions and second opening portions, respectively, in positions corresponding to the guide pins 94A and 94B of the first connector portion 91.

By thus using the two guide pins 94A and 94B disposed in different positions in the Y direction, when the first circuit board or the second circuit board is placed upside down, the two first opening portions of the first circuit board or the two second opening portions of the second circuit board are to be disposed in positions not corresponding to the positions of the two guide pins 94A and 94B, so that the two guide pins 94A and 94B cannot be fitted in the two first opening portions or the two second opening portions.

Thus, it is possible to, in addition to preventing the first circuit board and the second circuit board from being disposed in a wrong order and in wrong orientations, prevent the first circuit board and the second circuit board from being installed upside down and establish the connected state between the first circuit board and the second circuit board.

Also when the base plate 62 has the two guide pins 64 at its opposite ends in the X direction in Embodiment 2, the two guide pins 64 may be disposed in different positions in the Y direction.

Figure 15:
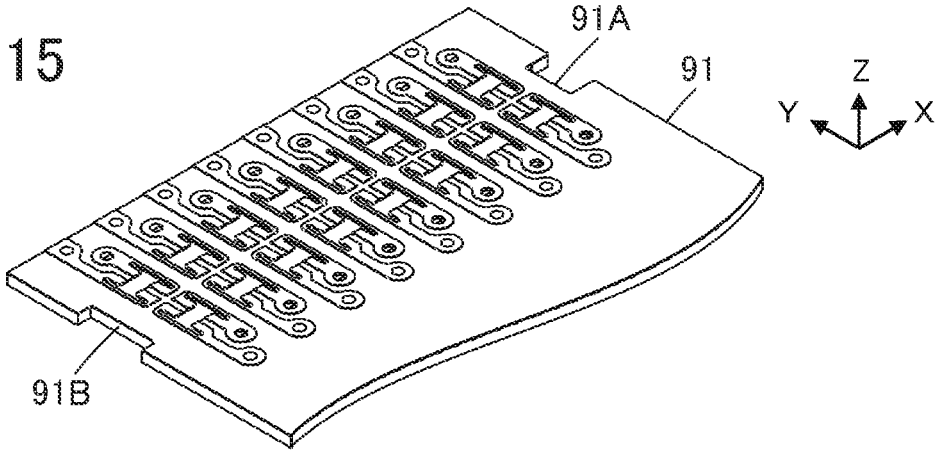
FIG. 15 is a partial perspective view showing a first circuit board used in a connector according to a modification.
Figure 16:
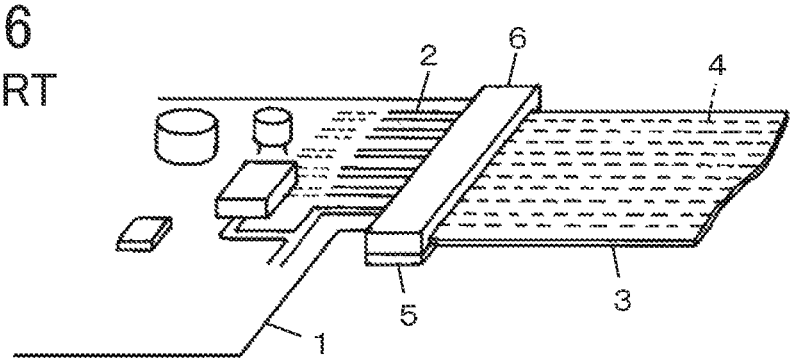
FIG. 16 PRIOR ART
FIG. 16 is a perspective view showing a conventional connector connecting an FPC and a flat cable.
Figure 17:
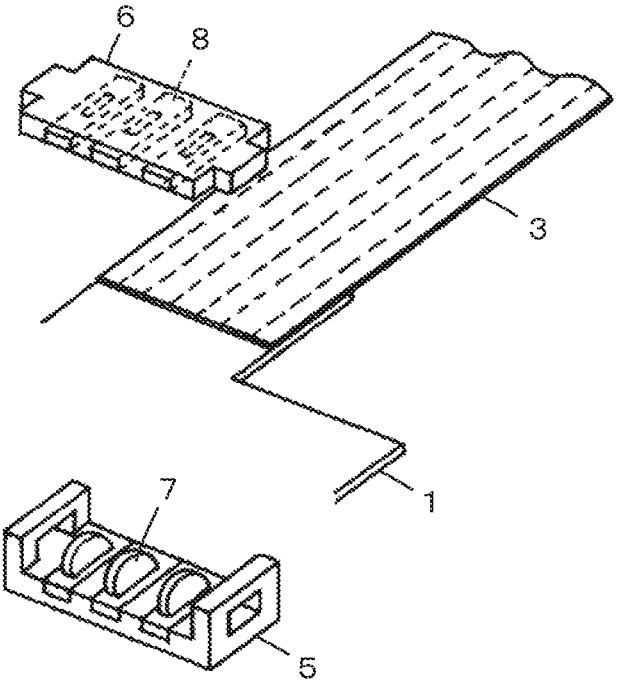
FIG. 17 PRIOR ART
FIG. 17 is an exploded perspective view of the conventional connector connecting the FPC and the flat cable.

While, in Embodiments 1 to 3 above, the first opening portions G1A and G1B of the first circuit board 41, the second opening portions G2A and G2B of the second circuit board 51, the first opening portion G1 of the first circuit board 71, and the second opening portion G2 of the second circuit board 81 are each formed as a through hole, each may be formed as, for example, a cut-out similarly to the first opening portions 91A and 91B of the first circuit board 91 shown in FIG. 15.

While the guide pins 24A and 24B of the first connector portion 21, the guide pin 64 of the connector 61, and the guide pins 94A and 94B of the first connector portion 91 are each a plate member extending in the Y direction, the invention is not limited thereto. Each of these guide pins may be a plate member extending in the X direction or a plate member extending obliquely to the X direction and the Y direction as long as it projects in the Z direction and has a first fitting portion disposed on the root side and a second fitting portion disposed on the tip side.

Another example of a guide pin that may be used is a cylindrical member having a central axis extending in the Z direction, the cylindrical member being provided on its root side with a first fitting portion with a relatively large diameter and on its tip side with a second fitting portion with a diameter smaller than the diameter of the first fitting portion. When such a cylindrical guide pin is used, circular through holes are preferably used as a first opening portion of a first circuit board and a second opening portion of a second circuit board.

In Embodiments 1 to 3 above, two electric path systems constituted of the first contact portions 47A and 47B and the second contact portions 57A and 57B are formed in a single fitting hole 23, and two electric path systems constituted of the first contact portions 77A and 77B and the second contact portions 87A and 87B are formed in a single through hole 85; however, one or three or more electric path systems may be formed in a single fitting hole 23 or a single through hole 85 in the same manner.

The number of the first fitting holes 23, 93 of the first connector portion 21, 91, the number of the projections 33 of the second connector portion 31, the number of the first through holes 45 of the first circuit board 41, and the number of the second through holes 55 of the second circuit board 51 in Embodiments 1 and 3 are each not limited to "16" and may each be one or more.

In Embodiments 1 to 3, the first circuit board 41, 71 is constituted of a circuit board including the flexible first substrate 42, 72 having insulation properties, and the second circuit board 51 is constituted of a circuit board including the flexible second substrate 52 having insulation properties; however, the invention is not limited thereto. The present invention is widely applicable to a connector that enables a first circuit board having a first contact portion and a second circuit board having a second contact portion to be overlapped on each other to electrically connect the first contact portion and the second contact portion to each other, and one or both of the first circuit board and the second circuit board may each be constituted of a printed circuit board or a rigid board.

What is claimed is:

1. A connector for overlapping a first circuit board having a first contact portion and a second circuit board having a second contact portion in a connecting direction to electrically connect the first contact portion and the second contact portion to each other, the connector comprising:

a first connector portion having a fitting hole;

a second connector portion having a projection corresponding to the fitting hole;

one or more guide pins protrudingly formed at one of the first connector portion and the second connector portion, wherein each of the one or more guide pins includes a first fitting portion disposed on a root side of the guide pin and fitted with the first circuit board and a second fitting portion disposed on a tip side of the guide pin and fitted with the second circuit board, and the first fitting portion has a width larger than that of the second fitting portion in a direction perpendicular to the connecting direction, wherein the first circuit board has a first through hole in which the first contact portion is disposed, wherein the second circuit board has a second through hole in which the second contact portion is disposed, wherein the first contact portion and the second contact portion are bendable, wherein at least one of the projection and the fitting hole has elasticity, and wherein when the projection of the second connector portion inserted in the first through hole of the first circuit board and the second through hole of the second circuit board is fitted into the fitting hole of the first connector portion, the first contact portion of the first circuit board and the second contact portion of the second circuit board are elastically pressed against each other between a lateral surface of the projection and an inner surface of the fitting hole to be electrically connected to each other.

2. The connector according to claim 1, wherein each of the one or more guide pins is configured such that a tip of the guide pin is disposed within a thickness range of the second circuit board when the second fitting portion is fitted with the second circuit board.

3. The connector according to claim 1, wherein the first fitting portion is fitted in a first opening portion formed in the first circuit board, wherein the second fitting portion is fitted in a second opening portion formed in the second circuit board, and wherein the width of the first fitting portion is larger than that of the second opening portion in the direction perpendicular to the connecting direction.

4. The connector according to claim 3, wherein, in order to define an order of overlapping of the first circuit board and the second circuit board, in the direction perpendicular to the connecting direction, a width T2 of the second opening portion is equal to or greater than a width S2 of the second fitting portion, a width S1 of the first fitting portion is greater than the width T2, a width T1 of the first opening portion is equal to or greater than the width S1.

5. The connector according to claim 3, wherein each of the first opening portion and the second opening portion comprises a hole or a cut-out penetrating the first circuit board and the second circuit board, respectively.

6. The connector according to claim 1, wherein two guide pins are protrudingly formed at the one of the first connector portion and the second connector portion as the one or more guide pins, and wherein the first fitting portions of the two guide pins have different widths in the direction perpendicular to the connecting direction from each other.

7. The connector according to claim 6, wherein the first fitting portions of the two guide pins are fitted in two first opening portions formed in the first circuit board, and wherein the second fitting portions of the two guide pins are fitted in two second opening portions formed in the second circuit board.

8. The connector according to claim 7, wherein, in order to define an order of overlapping and orientations of the first circuit board and the second circuit board, in the direction perpendicular to the connecting direction, a width T2A of the second opening portion G2A corresponding to the second fitting portion F2A of one of the two guide pins is equal to or greater than a width S2A of the second fitting portion F2A, a width S1A the first fitting portion F1A of the one of the two guide pins is greater than the width T2A, a width T1A of the first opening portion G1A corresponding to the first fitting portion F1A is equal to or greater than the width S1A, a width S2B of the second fitting portion F2B of the other of the two guide pins is greater than the width T1A, a width T2B of the second opening portion G2B corresponding to the second fitting portion F2B is equal to or greater than the width S2B, a width S1B of the first fitting portion F1B of the other of the two guide pins is greater than the width T2B, a width T1B of the first opening portion G1B corresponding to the first fitting portion F1B is equal to or greater than the width S1B.

9. The connector according to claim 6, wherein the first circuit board has a plurality of the first contact portions arranged, wherein the second circuit board has a plurality of the second contact portions arranged correspondingly to the plurality of the first contact portions, and wherein the two guide pins are disposed separately at opposite ends of the one of the first connector portion and the second connector portion in an arrangement direction in which the plurality of the first contact portions and the plurality of the second contact portions connected to each other are arranged.

10. The connector according to claim 9, wherein the two guide pins are disposed in different positions in a direction perpendicular to the arrangement direction.

11. A connector for overlapping a first circuit board having a first contact portion and a second circuit board having a second contact portion in a connecting direction to electrically connect the first contact portion and the second contact portion to each other, the connector comprising:

a flat plate portion; and one or more guide pins protrudingly formed on a surface of the flat plate portion, wherein each of the one or more guide pins includes a first fitting portion disposed on a root side of the guide pin and fitted with the first circuit board and a second fitting portion disposed on a tip side of the guide pin and fitted with the second circuit board, and the first fitting portion has a width larger than that of the second fitting portion in a direction perpendicular to the connecting direction, wherein the first circuit board has a first through hole in which the first contact portion is disposed, wherein the second circuit board has a second through hole in which the second contact portion is disposed, wherein the connector includes a projection that is inserted into the first through hole of the first circuit board and the second through hole of the second circuit board so that the first contact portion and the second contact portion are connected to each other, wherein the projection is protrudingly formed on the surface of the flat plate portion and has elasticity, wherein the first contact portion is bendable, wherein the second through hole of the second circuit board is formed of a through hole in which the second contact portion is formed on an inner surface thereof, and wherein when the projection is fitted into the through hole, the first contact portion of the first circuit board is elastically pressed against the inner surface of the through hole to electrically connect the first contact portion and the second contact portion to each other.

12. The connector according to claim 11, wherein each of the one or more guide pins is configured such that a tip of the guide pin is disposed within a thickness range of the second circuit board when the second fitting portion is fitted with the second circuit board.

13. The connector according to claim 11, wherein the first fitting portion is fitted in a first opening portion formed in the first circuit board, wherein the second fitting portion is fitted in a second opening portion formed in the second circuit board, and wherein the width of the first fitting portion is larger than that of the second opening portion in the direction perpendicular to the connecting direction.

14. The connector according to claim 13, wherein, in order to define an order of overlapping of the first circuit board and the second circuit board, in the direction perpendicular to the connecting direction, a width T2 of the second opening portion is equal to or greater than a width S2 of the second fitting portion, a width S1 of the first fitting portion is greater than the width T2, a width T1 of the first opening portion is equal to or greater than the width S1.

15. The connector according to claim 13, wherein each of the first opening portion and the second opening portion comprises a hole or a cut-out penetrating the first circuit board and the second circuit board, respectively.

16. The connector according to claim 11, wherein two guide pins are protrudingly formed on the surface of the flat plate portion as the one or more guide pins, and wherein the first fitting portions of the two guide pins have different widths in the direction perpendicular to the connecting direction from each other.

17. The connector according to claim 16, wherein the first fitting portions of the two guide pins are fitted in two first opening portions formed in the first circuit board, and wherein the second fitting portions of the two guide pins are fitted in two second opening portions formed in the second circuit board.

18. The connector according to claim 17, wherein, in order to define an order of overlapping and orientations of the first circuit board and the second circuit board, in the direction perpendicular to the connecting direction, a width T2A of the second opening portion G2A corresponding to the second fitting portion F2A of one of the two guide pins is equal to or greater than a width S2A of the second fitting portion F2A, a width S1A the first fitting portion F1A of the one of the two guide pins is greater than the width T2A, a width T1A of the first opening portion G1A corresponding to the first fitting portion F1A is equal to or greater than the width S1A, a width S2B of the second fitting portion F2B of the other of the two guide pins is greater than the width T1A, a width T2B of the second opening portion G2B corresponding to the second fitting portion F2B is equal to or greater than the width S2B, a width S1B of the first fitting portion F1B of the other of the two guide pins is greater than the width T2B, a width T1B of the first opening portion G1B corresponding to the first fitting portion F1B is equal to or greater than the width S1B.

19. The connector according to claim 16, wherein the first circuit board has a plurality of the first contact portions arranged, wherein the second circuit board has a plurality of the second contact portions arranged correspondingly to the plurality of the first contact portions, and wherein the two guide pins are disposed separately at opposite ends of the flat plate portion in an arrangement direction in which the plurality of the first contact portions and the plurality of the second contact portions connected to each other are arranged.

20. The connector according to claim 19, wherein the two guide pins are disposed in different positions in a direction perpendicular to the arrangement direction.

* * * * *